US006196492B1

(12) United States Patent
Baumeister

(10) Patent No.: US 6,196,492 B1
(45) **Date of Patent: *Mar. 6, 2001**

(54) ROLL WINDER AND PROCESS OF OPERATING SAME

(75) Inventor: Thomas Baumeister, Tönisvorst (DE)

(73) Assignee: Voith Sulzer Papiertechnik Patent GmbH, Heidenheim (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/237,386

(22) Filed: Jan. 27, 1999

(30) Foreign Application Priority Data

Jan. 28, 1998 (DE) ..... 198 03 137

(51) Int. Cl.[7] ..... B65H 18/02
(52) U.S. Cl. ..... 242/541.5; 242/533.3
(58) Field of Search ..... 242/541, 533.3, 242/541.5, 541.6, 542.3, 547

(56) References Cited

U.S. PATENT DOCUMENTS

| | | | | |
|---|---|---|---|---|
| 2,285,358 | * | 6/1942 | Rode et al. | 242/564.5 |
| 3,098,619 | | 7/1963 | Washburn . | |
| 3,286,944 | * | 11/1966 | Kusel | 242/533.3 |
| 3,851,832 | * | 12/1974 | Krueckels et al. | 242/541.6 |
| 4,746,076 | * | 5/1988 | Tomma et al. | 242/541.5 X |
| 4,778,119 | * | 10/1988 | Yamazaki et al. | 242/547 X |
| 5,938,144 | * | 8/1999 | Kaipf et al. | 242/541.6 X |
| 5,961,065 | * | 10/1999 | Tomma et al. | 242/541.5 |

FOREIGN PATENT DOCUMENTS

| | | |
|---|---|---|
| 402064 | 9/1924 | (DE) . |
| 3625221 | 2/1987 | (DE) . |
| 3940702 | 6/1991 | (DE) . |

* cited by examiner

*Primary Examiner*—Donald P. Walsh
*Assistant Examiner*—Collin A. Webb
(74) *Attorney, Agent, or Firm*—Greenblum & Bernstein, P.L.C.

(57) ABSTRACT

Roll winder and process for operating the same. The roll winder includes a roll retainer adapted to hold a wound roll in the region of a wound roll pivot axis, and a support apparatus that includes a plurality of roll bodies having axes extending substantially parallel to the pivot axis of the wound roll. The plurality of roll bodies are formed into a plurality of roll pairs, and the roll pairs are pivotably mounted for movement around a shaft extending substantially parallel to the pivot axis of the wound roll. The process includes positioning one of the roll pairs against a winding tube, pressing the winding tube against a central roll with the one roll pair, guiding a web onto the winding tube and rotating the winding tube to form a wound roll, and pivoting the one roll pair so that all of the plurality of roll pairs are positioned beneath the wound roll.

19 Claims, 4 Drawing Sheets

ROLL WINDER AND PROCESS OF OPERATING SAME

CROSS-REFERENCE TO RELATED APPLICATIONS

The present application claims priority under 35 U.S.C. §119 of German Patent Application No. 198 03 137.8, filed on Jan. 28, 1998, the disclosure of which is expressly incorporated by reference herein in its entirety.

BACKGROUND OF THE INVENTION

1. Field of the Invention

The present invention is related to a roll winder including a roll retainer, which is coupled to a wound roll in the region of its pivot axis, to a support apparatus, and to a process.

2. Discussion of Background Information

Beyond certain roll diameters, roll winders, which are provided to hold a roll in a region of its pivot axis, require that the wound roll be supported from below. Otherwise, under the influence of its own weight, the wound roll would sag too much, which can lead to damage to the web of material.

However, supporting the wound roll from below leads to the problem that the bearing pressure has an influence on the winding hardness. In particular, for take-up winding, the influence of bearing pressure on the winding hardness can lead to undesired results. In principle, it is desirable to have the winding hardness decrease from the inside out. However, with increasing bearing pressure, winding hardness increases from the inside out, i.e., contrary to the desired effect.

Some suggestions have already been made in the prior art for addressing this problem. For example, one proposal is based on supporting the wound roll on an air cushion. However, this is relatively energy-intensive. Another solution is to arrange the wound roll on a revolving belt that is tensed between two deflection rolls, which sometimes causes considerable wear.

SUMMARY OF THE INVENTION

The present invention provides a device for supporting a wound roll that does not suffer from the above-noted drawbacks of the prior art.

In a roll winder of the type generally discussed above, a support apparatus is provided having a plurality of roll bodies with axes extending parallel to the pivot axis of the wound roll and which are combined into pairs of rolls. Each pair of rolls are pivotable about a shaft that extends parallel to the pivot axis.

In this manner, because the wound roll is always supported on or by a plurality of roll bodies, the bearing force is distributed over a plurality of bearing faces. Correspondingly, the resultant contact pressure remains within allowable limits. Because the pairs of rolls are pivotable, they automatically adjust to adapt to the circumference of the wound roll. This ensures that the wound roll will rest on the roll bodies. When the wound roll diameter is small, the individual roll bodies are loaded differently. However, this is not critical, since at a smaller diameter the force of gravity of the roll is also less. Hence, the contact pressure remains low. The greater the diameter of the wound roll becomes, the more uniformly the roll bodies are loaded. In other words, the roll bodies take part in distributing the bearing force, which limits the force per bearing point.

Preferably, two pairs of rolls may be arranged on a pivotable rocker, whose pivot shaft extends parallel to the pivot axis. The rocker permits a largely uniform support of the wound roll by the roll bodies even if the wound roll is not located symmetrically between the roll pairs. In such a case, the rocker may be inclined somewhat. Moreover, a plurality of rockers can also be provided, which then, because they are pivotable, can adapt to the diameter of the wound roll.

Advantageously, the roll pairs may be spaced apart from one another on the rocker and located under the wound roll in the direction of gravity by a distance at which the respective outer roll bodies are less than approximately 800 mm away from each other. The magnitude of approximately 800 mm has been selected because, beyond this diameter, the dead weight force becomes so great that support from below becomes necessary. If the two outer roll bodies are less than 800 mm away from one another, then beyond this diameter in the take-up winding process, or down to this diameter in unwinding, the wound roll is supported by all the roll pairs.

Advantageously, the rocker may be arranged on a carrier that is pivotable about a pivot shaft extending parallel to the pivot axis. The arrangement has advantages, particularly if the pivot axis of the wound roll remains in the same plane, e.g., when the roll retainer is arranged in stationary fashion. In this case, the change in diameter upward or downward can be followed by pivoting of the carrier.

Advantageously, the pivot shaft of the carrier is stationary, and a connection point of the carrier to the rocker may then describe a circular arc. In many cases, the arc can be placed so that, e.g., in unwinding, it corresponds to a portion of a circle disposed in the vicinity of a vertically extending tangent. In this case, the support of the wound roll by the roll bodies remains largely symmetrical. Furthermore, the stationary support of the pivot shaft of the carrier makes construction simpler.

Preferably, the carrier may include a carrier pivot drive mechanism. In the unwinding operation, the carrier pivot drive mechanism can guide the roll bodies to follow the decreasing diameter of the wound roll and can ensure that the wound roll is always sufficiently supported from below. in the take-up winding, the pivot drive mechanism can lower the carrier, so as to establish the desired force ratios.

In an advantageous embodiment, it is provided that the spacing of the roll bodies within the roll pairs and the spacing of the bearing points of the wound roll from the pivot shafts of the roll pairs may be adapted to the spacing of the individual pivot shafts so that, with increasing diameter, the wound roll is supported substantially symmetrically to its vertical center plane. Such an embodiment may be especially advantageous when a support apparatus is used in a winding operation in which a central roll is provided to bear against the wound roll in winding procedure. The contact pressure of the wound roll against the central roll primarily determines the winding hardness. As the diameter of the wound roll increases, the pivot axis of the wound roll moves farther away from the central roll, however, the pivot axis remains in the same horizontal plane as the pivot axis of the central roll. As a result, the lowest point of the wound roll moves obliquely downward along a straight line at an angle of 45°. The carrier, which is pivotable about a carrier pivot shaft, executes a circular motion. However, the wound roll does not rest against the pivot shaft of the rocker, but against the roll bodies, which are spaced apart from this pivot shaft and are still separated by the pivot shaft of the roll pairs. Because of the latter pivot shaft, the circular motion of the carrier is somewhat compensated for by a counter-pivoting of the roll pairs, so that the contact points of the wound roll body extend in such a way that at least approximately largely symmetrical loading is assured. This loading can be limited to certain diameter ranges of the wound roll, e.g., within a range of approximately 800–1500 mm in diameter.

In an advantageous embodiment, the rocker may be pivotable relative to the carrier by an angle on the order of magnitude of from approximately 50° to 100°. Particularly in the winding operation, one roll pair of the support apparatus can then be used to press the winding tube of the wound roll and the wound roll, when the winding roll diameter is small, against the central roll so that the high winding hardness desired can be established at the outset of the winding operation. Moreover, in this way, sagging of the winding tube or wound roll due to web tension and from the contact pressure of the roll retainer when the roll diameter is small can be prevented. However, care should be taken to enable the roll body to exert a substantially horizontally oriented force on the wound roll, which is accomplished by the pivotability of the rocker relative to the carrier.

It may be preferred to position a rocker pivot drive mechanism between the carrier and the rocker. With the aid of the rocker pivot drive mechanism, the requisite adjustment of the rocker relative to the carrier and the requisite force on the winding tube or wound roll with the small diameter can then be exerted.

In an alternative embodiment, the carrier and the rocker can be rigidly coupled, and the carrier may be pivotable about an angle on the order of magnitude of from approximately 60° to 100°. In this case, the requisite horizontal force may be brought to bear overall by the pivoting of the carrier. It is true that in this embodiment it is no longer ensured that the support of the wound roll is always symmetrical. On the contrary, it should be assumed that, up to a certain diameter of the wound roll, there will always be one force component in the direction of the central roll. An approximately symmetrical loading with the attendant more uniform bearing forces does not occur until larger diameters of the wound roll, where that is also necessary and desired.

Advantageously, the roll bodies may have an elastic surface. This surface further reduces the bearing pressures and facilities the automatic adjustment of the pairs of roll bodies.

It may be advantageous that the rolls of the support apparatus be movable along a path in which, at the onset of winding with one roll pair, they fix the winding tube and the wound roll being formed thereon in position and, after a transitional phase, support the now larger wound roll from below with all the roll pairs. The support apparatus therefore performs multiple functions.

It is also recommended that the rocker can be displaced far enough that the finished wound roll may be expelled. This additional function can also be assigned to the rocker without difficulty.

It is advantageous that the support apparatus includes segments arranged side by side, in which the number of segments depends upon the width of the web to be wound up. The segmentation makes it possible in a simple way to take into account different widths of partial-width webs.

Accordingly, the present invention is directed to a roll winder that includes a roll retainer adapted to hold a wound roll in the region of a wound roll pivot axis, and a support apparatus that includes a plurality of roll bodies having axes extending substantially parallel to the pivot axis of the wound roll. The plurality of roll bodies are formed into a plurality of roll pairs, and the roll pairs are pivotably mounted for movement around a shaft extending substantially parallel to the pivot axis of the wound roll.

In accordance with another feature of the present invention, a pivotable rocker has a pivot shaft extending substantially parallel to the pivot axis of the wound roll, and the plurality of roll pairs include two pairs of rolls coupled to the pivotable rocker.

In accordance with a further feature of the present invention, the two pairs of rolls are spaced apart from one another on the pivotable rocker, and outermost rolls of the two pairs of rolls are spaced apart a distance of less than approximately 800 mm. The two pairs of rolls are positionable under a wound roll relative to the direction of gravity.

In accordance with still another feature of the present invention, a carrier is pivotably mounted to move about a pivot axis that extends substantially parallel to the pivot axis of the wound roll.

In accordance with another feature of the present invention, the pivot shaft of the carrier is stationary.

In accordance with a still further feature of the present invention, the carrier includes a carrier pivot drive mechanism.

In accordance with another feature of the present invention, the spacing of the plurality of roll bodies and a spacing of bearing points of the wound roll from the pivot shafts of the two pairs of rolls are adapted to correspond to a spacing of the roll pair shafts, the pivotable rocker shaft, and the carrier shaft. As the diameter of the wound roll increases, the wound roll is supported substantially symmetrically to a vertical center plane.

In accordance with still another feature of the present invention, the rocker is pivotable relative to the carrier by an angle on the order of magnitude of between approximately 50° to 100°.

In accordance with a further feature of the present invention, a rocker pivot drive mechanism is arranged between the carrier and the rocker.

In accordance with another feature of the present invention, the carrier and the rocker are rigidly coupled together, and the carrier is pivotable about an angle on the order of magnitude of between approximately 60° to 100°.

In accordance with still another feature of the present invention, the roll bodies have an elastic surface.

In accordance with another feature of the present invention, at an onset of winding a wound roll on a winding tube, one of the roll pairs of the support apparatus is movably positioned along a fixed path against one of the winding tube and the wound roll. As the diameter of the wound roll increases, all of the rolls of the support apparatus are positioned beneath the wound roll to support the wound roll.

In accordance with a further feature of the present invention, the rocker is displaceable to facilitate expelling of a finished wound roll.

In accordance with a still further feature of the present invention, the support apparatus is composed of segments that are arranged adjacent to each other. A total number of the segments is dependent on the width of the web to be wound.

The present invention is directed to a support device for a roll winder that includes a central roll, a roll retainer adapted to be coupled to a winding tube upon which a wound roll is formed. The support device includes a rocker device, a first and second roll pair pivotably coupled to the rocker device, a carrier pivotably coupled to the rocker device, and an end of the carrier remote from the rocker device being pivotably coupled below a rotational axis of the central roll.

In accordance with another feature of the present invention, a rocker device drive mechanism is coupled between the carrier and the rocker device, and a carrier drive mechanism is coupled between the carrier and the stationary part. During a beginnign part of a winding procedure, the rocker device drive mechanism and the carrier drive mechanism drive the first roll pair to press the winding tube against the central roll, and adapted to press the wound roll against the central roll. During a latter part of the winding procedure, the first and second roll pairs are adapted to support an outer circumferential surface of the wound roll.

The present invention is directed to a process of forming a wound roll with a roll winder and a support apparatus, the roll winder including a roll retainer adapted to hold a wound roll in the region of a wound roll pivot axis, and the support apparatus including a plurality of roll bodies having axes extending substantially parallel to the pivot axis of the wound roll, such that the plurality of roll bodies form a plurality of roll pairs, and the roll pairs are pivotably mounted for movement around a shaft extending substantially parallel to the pivot axis of the wound roll. The process includes positioning one of the roll pairs against a winding tube, pressing the winding tube against a central roll with the one roll pair, guiding a web onto the winding tube and rotating the winding tube to form a wound roll, and pivoting the one roll pair so that all of the plurality of roll pairs are positioned beneath the wound roll.

In accordance with another feature of the present invention, the process further includes pivoting the one roll pair when a diameter of the wound roll is approximately 500 mm.

In accordance with still another feature of the present invention, the process further includes positioning all of the plurality of roll pairs beneath the wound roll when a diameter of the wound roll is approximately 800 mm.

In accordance with yet another feature of the present invention, the process further includes pivoting the plurality of roll pairs when winding of the wound roll is complete, whereby the wound roll is expelled from the roll winder.

According to still another feature of the present invention, the roll pairs are pivotably mounted on a rocker, the rocker includes a rocker shaft, and the process further includes moving the rocker shaft along an arcuate path.

According to yet another feature of the present invention, the roll pairs are pivotably mounted on a rocker, the rocker includes a rocker shaft, and the process further includes moving the rocker shaft along a linear path.

Other exemplary embodiments and advantageous of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Roll winders may be utilized to wind up a web of material to form a wound roll, or to pay out a web of material from a wound roll. While the discussion of the present invention will be described below in terms of an exemplary embodiment utilizing, e.g., a web of paper, this discussion is simply for the purposes of illustration, and is not intended to be limiting. Moreover, it is noted that the features of the present invention may be utilized in connection with any number of webs of material including, e.g., cardboard, plastic films, metal foils, etc.

Figure 1:
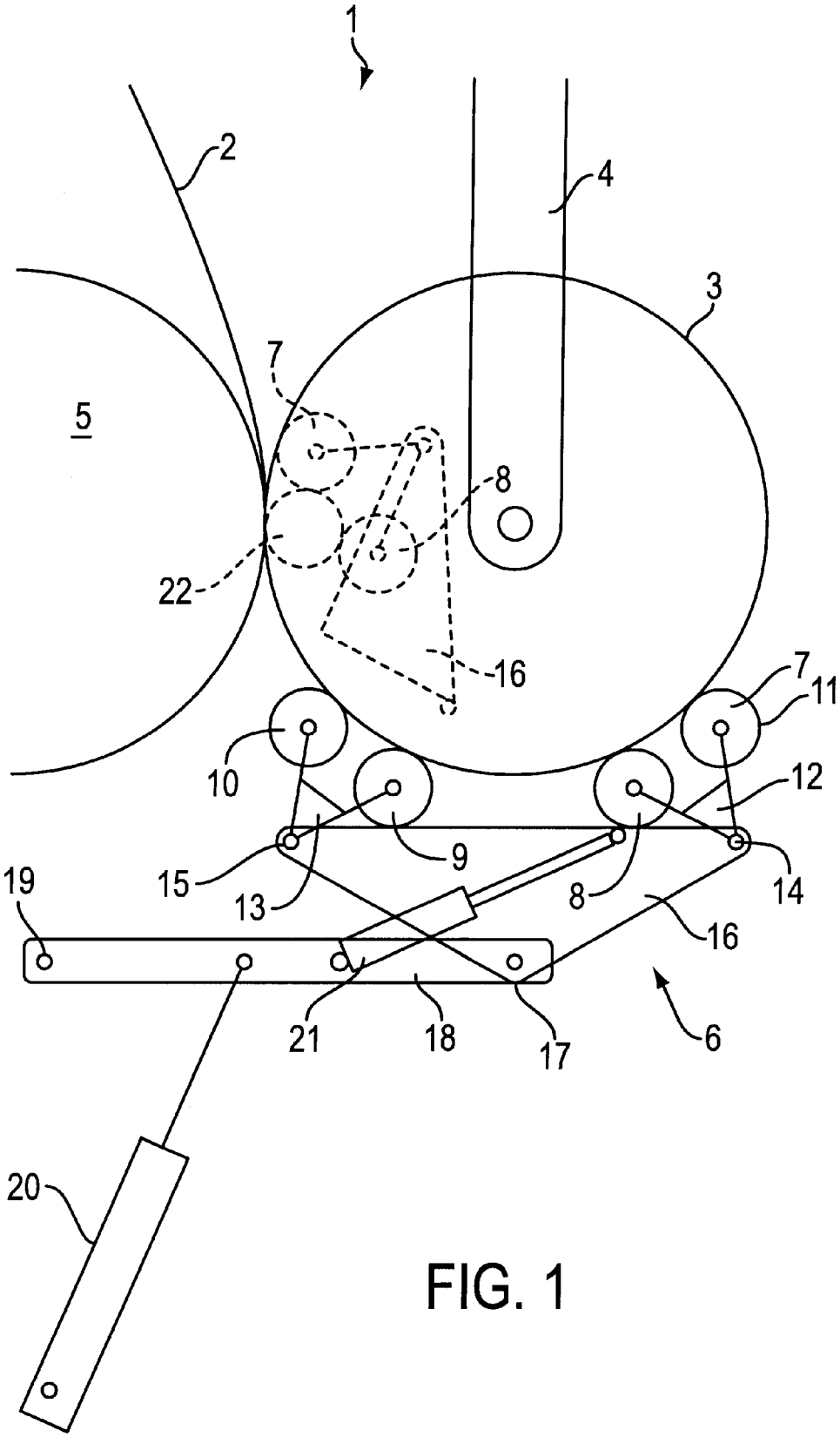
FIG. 1 schematically illustrates roll winder in accordance with the features of the present invention.

FIG. 1 schematically illustrates a roll winder 1 for winding up a web 2 of material, e.g., a paper web, into a wound roll 3. Wound roll 3 is depicted here as nearly fully wound, i.e., it has virtually reached its maximum diameter. Wound roll 3 may be held by a roll retainer 4 at the face ends of wound roll 3 to engage a roll core (not shown), i.e., wound roll 3 may be centrally held in a region of its pivot axis.

In a winding operation, wound roll 3 may be pressed against a central roll 5. The contact pressure against central roll 5 is one of the main factors in the winding hardness of wound roll 3.

Figure 1A:
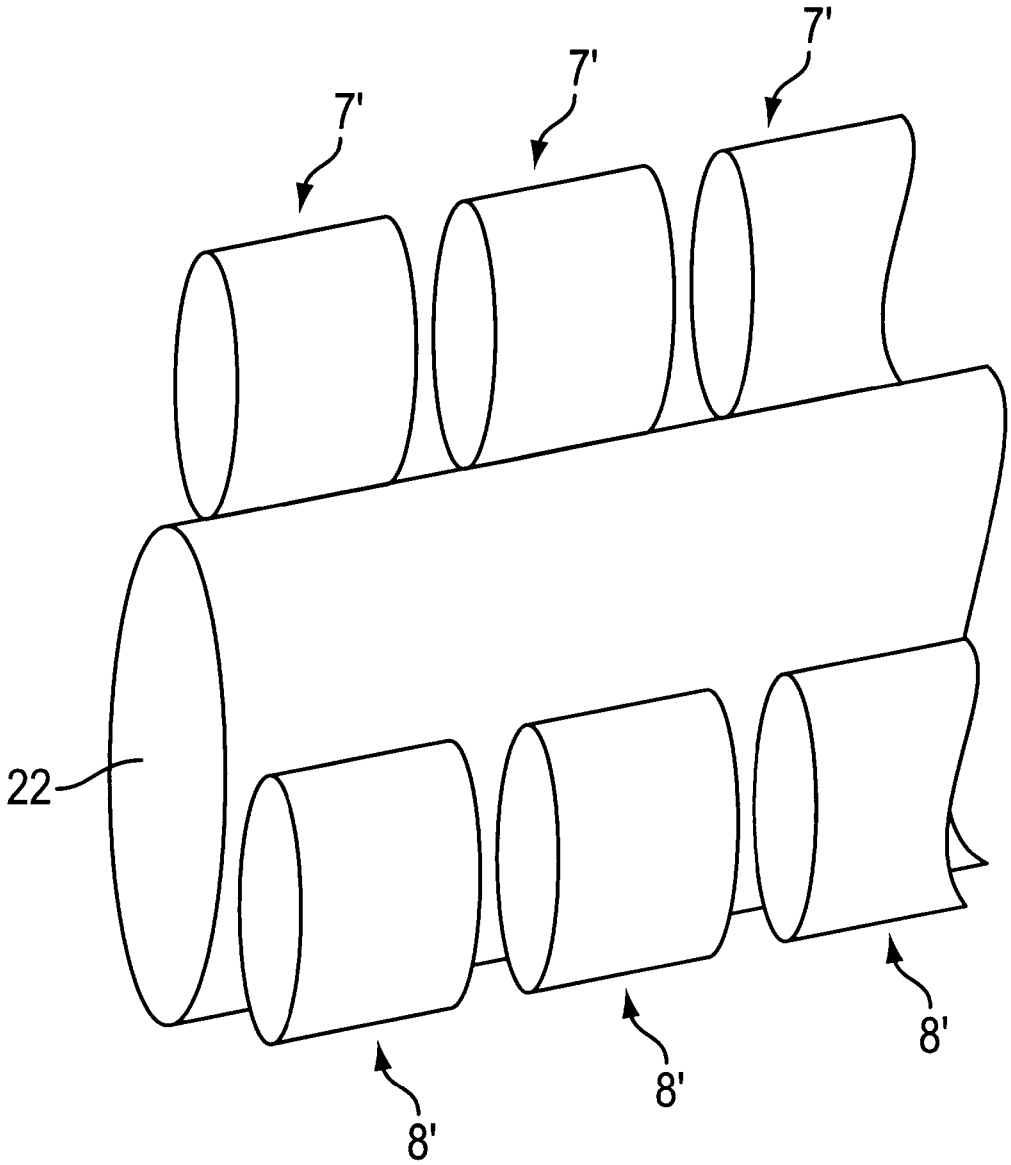
FIG. 1A schematically illustrates a perspective view of the dashed line portion depicted in FIG. 1 in which the roll bodies are segmented.

Generally, beyond a diameter of approximately 800 mm, the weight of wound roll 3 is so great that supporting the roll from below is necessary. To this end, a support apparatus 6 may be provided. Support apparatus 6 may include a plurality of roll bodies, e.g., four roll bodies 7–10. Roll bodies 7–10 may be formed as elongated rolls that are rotatable about a pivot axis arranged parallel to the pivot axis of wound roll 3. Alternatively, the roll bodies can be segmented, as shown in FIG. 1A, as roll bodies 7' and 8'. All of roll bodies 7–10 may be provided with an elastic surface 11, which may be, e.g., rubberized.

Roll bodies 7–10 may be combined into various roll pairs 12 and 13. Inside each roll pair 12 and 13, respective roll bodies 7 and 8, and 9 and 10 may be arranged rigidly relative to one another. Each roll pair 12 and 13 may be pivotable about a pivot shaft 14 and 15, relative to a rocker 16. One lever may be positioned between each of the roll bodies and the pivot shaft, and the levers may form an angle of less than approximately 180°, e.g., an angle of approximately 50°. Rocker 16 may be arranged on a carrier 18 and may be pivotable about a pivot shaft 17. Carrier 18, in turn, may be pivoted about a stationary pivot shaft 19.

Carrier 18 may be pivotable about pivot shaft 19 by a carrier pivot drive mechanism 20, so that pivot shaft 17 may describe a circular arc, i.e., travel in a circular path, about pivot shaft 19. A rocker pivot drive mechanism 21 may be coupled to rocker 16 to assist rocker 16 in pivoting relative to carrier 18.

A winding tube 22 (shown in dashed lines) is positioned to rest on central roll 5 and is firmly held in place by roll bodies 7 and 8 (shown in dashed lines). That is, the dashed lines indicate the status of the roll winder at the onset of a winding operation. To this end, carrier 18 may be pivoted upwardly by actuation of carrier pivot drive mechanism 20. Rocker 16 may be pivoted counterclockwise, relative to carrier 18, so that roll bodies 7 and 8 come to rest on winding tube 22. Web 2 can then be wound up, at a predetermined contact pressure, so that the desired winding hardness is established. Winding occurs in this manner up to a diameter of approximately 500 mm, i.e., with support provided by roll bodies 7 and 8. In other words, pressure of wound roll 3 against central roll 5 is exerted by roll bodies 7 and 8 and roll retainer 4.

As the wound roll continues to grow, rocker 16 may be pivoted out of the way and carrier 18 may be lowered, so that rocker 16 may be positioned below would roll 3. At this point, contact pressure is exerted only by roll retainer 4. Two outer roll bodies 7 and 10 may be spaced apart from one another by no more than approximately 800 mm. In this way, so that at the latest by the time would roll 3 has a diameter of approximately 800 mm, would roll 3 can be supported from below via roll pairs 12 and 13.

The diameter of wound roll 3 increases during the winding, and a center point (rotational axis) of wound roll 3 may be moved in a horizontal plane away from central roll 5. Accordingly, the lowest point of wound roll 3 moves obliquely downwardly along a plane that is inclined by 45° from the horizontal plane.

Once roll bodies 7–10 have been brought into contact with wound roll 3, carrier 18 may be raised somewhat and then lowered again in the winding process. Thus, pivot shaft 17 does not move obliquely downward along the 45° plane, but instead moves along a circular arc. However, since as the diameter of wound roll 3 increases, roll pairs 12 and 13 become increasingly horizontally oriented, the motion of the bearing points of wound roll 3 on roll bodies 7–10 may be simulated to a good approximation so that a largely symmetrical support of wound roll 3 on support apparatus 6 may be provided. However, it is noted that an exact symmetrical support is unattainable in most cases, and is not absolutely necessary. The angle that rocker 16 can assume relative to carrier 18 depends on given conditions. It is preferably on the order of magnitude of approximately 50° to 100°.

In summary, support apparatus 6 with rocker 16, if used optimally, can therefore, perform the following:

1. Once empty winding tube 22 has been pressed against central roll 5, e.g., with the aid of tension heads, and the beginning of web 2 has been glued to winding tube 22, rocker 16 is pivoted so that winding tube 22 is fixed in its position by roll pair 12. The requisite pressure for pressing winding tube 22 against central roll 5 is generated or exerted by the tension heads and rolls 7 and 8 of roll pair 12. In this way, during winding and thereafter, winding tube 22 cannot warp in response to external forces (e.g., web tension, contact pressure of the tension heads).

2. Once wound roll 3 has reached a certain diameter, e.g., approximately 500 mm, rocker 16 is pivoted against the underside of wound roll 3. The requisite contact pressure is now brought to bear only by the tension heads.

3. Beyond a wound roll diameter of approximately 800 mm, roll pairs 12 and 13 are provided to support wound roll 3 from below until it is completely wound. Because wound roll 3 at larger diameters (e.g., up to approximately 1500 mm) is relieved, peak tension values in the region of the tension heads caused by sagging, and also a shifting of the center point from sagging of the paper webs, are prevented.

4. As soon as the rated or desired diameter is reached, the winding operation is stopped, web 2 is cut, and the tension heads are moved out of winding tube 22. The finished wound roll 3 is then expelled by a further pivoting of rocker 16.

In the course of this path of motion, rocker 16 is pivoted by approximately 90°.

Figure 2:
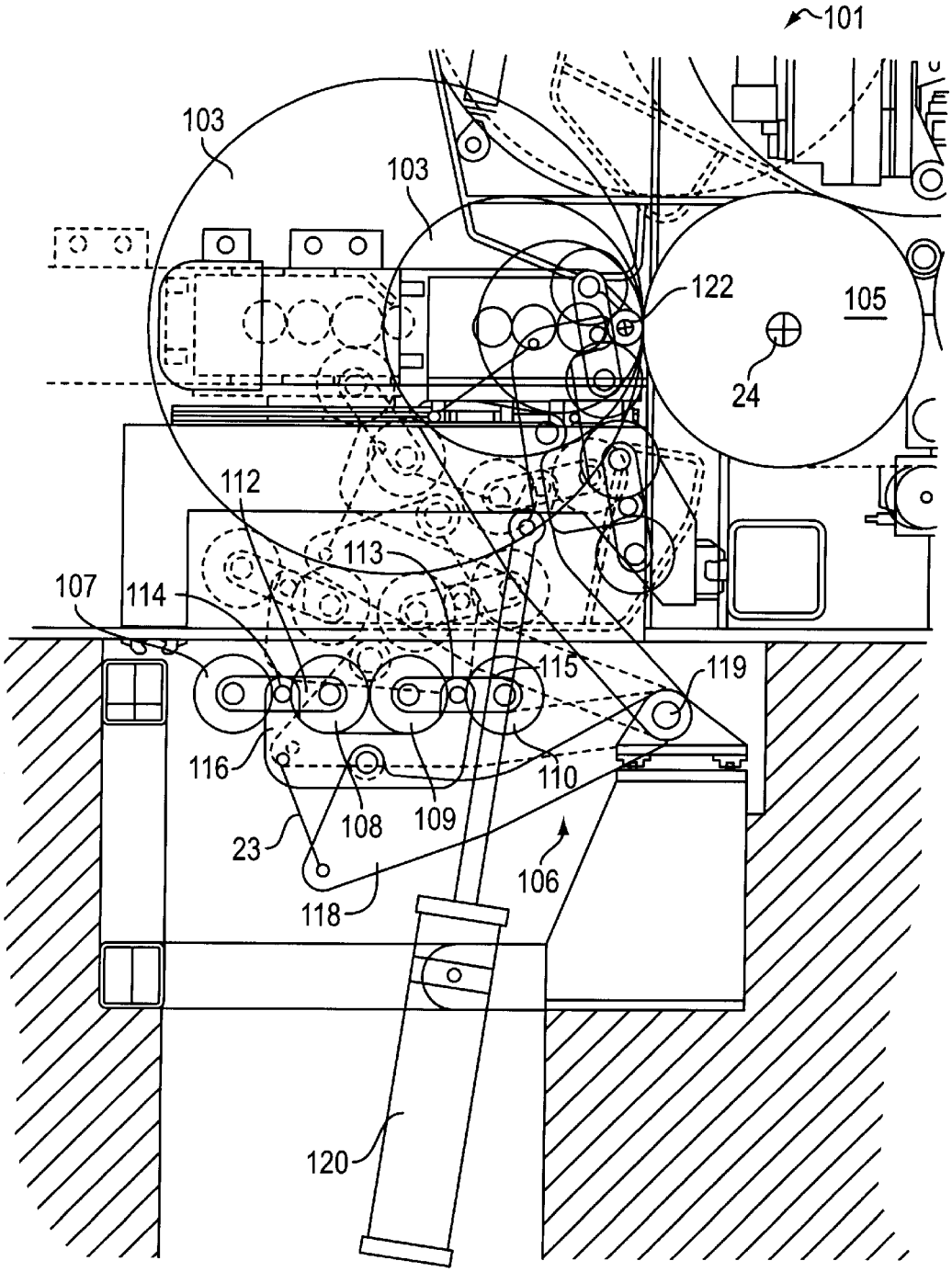
FIG. 2 illustrates a second embodiment of a roll winder for a winding operation.

FIG. 2 shows an alternative embodiment of the present invention, in which identical or equivalent elements are identified by the same reference numerals increased by a value of 100.

In contrast to the exemplary embodiment of FIG. 1, FIG. 2 includes a rigid connection 23 between rocker 116 and carrier 118. Rocker 116 and carrier 118 are, therefore, always oriented at a same angle to one another.

Solid lines show support apparatus 106 in its lowermost, i.e., not active, position, i.e., it is lifted away from wound roll 103. Support apparatus 106 is also shown in solid lines in a position where it presses driven winding tube 122 against central roll 105, which has a drive mechanism 24. In between, the positions of support apparatus 106 for two different diameters of wound roll 103 are shown in dashed lines. It can be seen that for a medium diameter of wound roll 103, support of wound roll 103 from below is done by two roll bodies 109 and 110 positioned adjacent to central roll 105, while the two roll bodies 107 and 108 still exert a pronounced force component in the direction of central roll 105. When wound roll 103 grows larger, the support by support apparatus 106 then becomes increasingly symmetrical. The greater the diameter of wound roll 103, the greater is its weight and thus, the more unformily the bearing forces are distributed.

In the embodiment of FIG. 2, roll bodies 107–100 are each secured only to a simple lever, which is pivotable about pivot shafts 114 and 115. This is a somewhat simpler embodiment than that depicted in FIG. 1.

Figure 3:
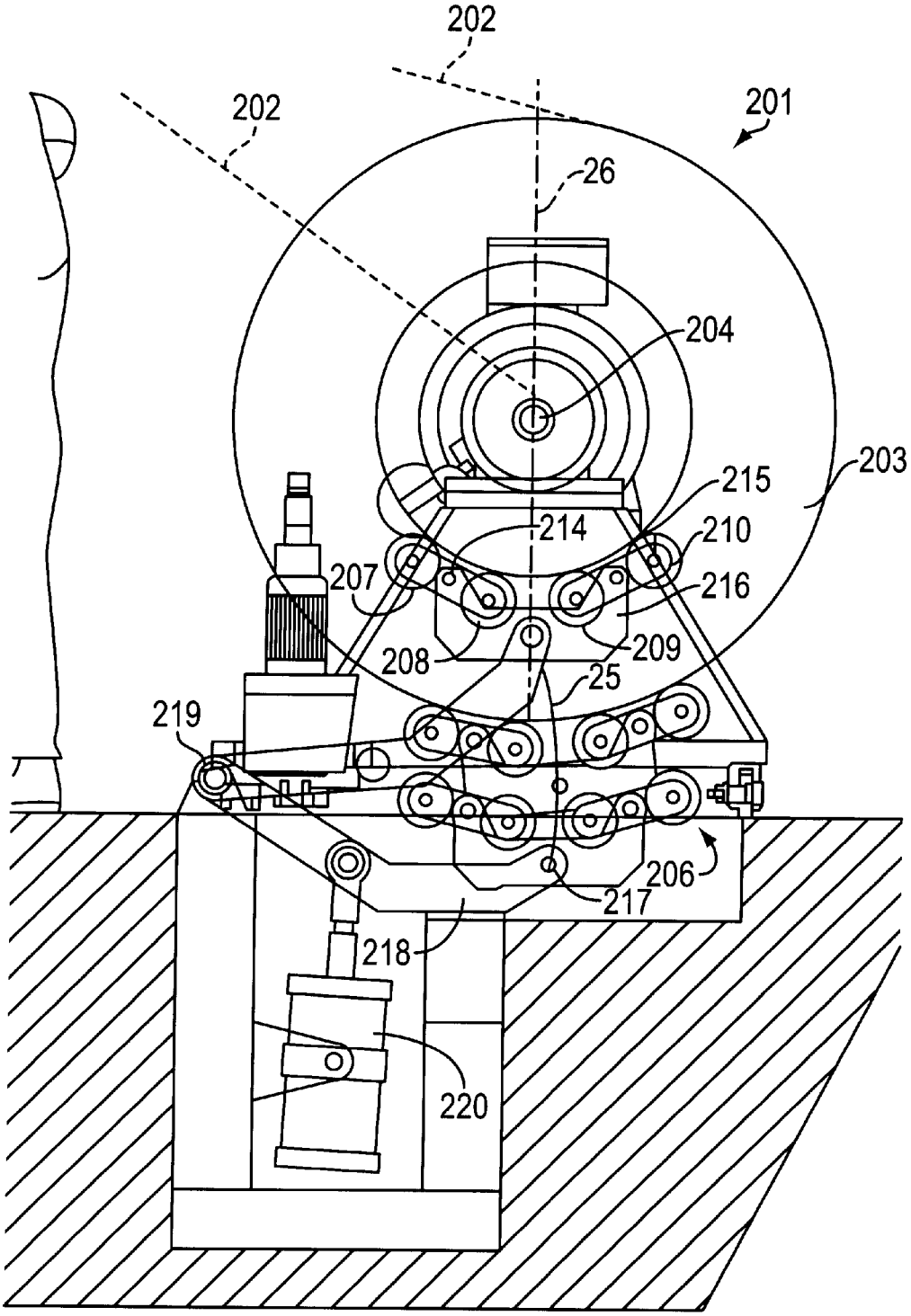
FIG. 3 illustrates a third embodiment of a roll winder for an unwinding operation.

FIG. 3 illustrates a third embodiment, in which support apparatus 206 is located in an unwinding device 201. Identical and equivalent elements are identified by the same reference numerals as in FIG. 1 increased by a value of 200.

Pivot shaft 217 is pivoted along a circular arc 25 about pivot shaft 219. Circular arc 25 has an at least approximately perpendicularly oriented tangent. Accordingly, support apparatus 206, as wound roll 203 is unwound, can be guided substantially symmetrically to a vertical center plane of wound roll 203. However, it suffices if the wound roll is supported on both sides of this plane 26.

In roll cutting, wound rolls 3 of various widths are to be wound up. For this reason, rockers 16, 116, 216 are installed in the form of segments, e.g., in those winding positions in which narrow webs are to be wound, only one segment is installed, while for wider webs two or more segments are installed. Advantageously, the segment can be displaceable transversely to the web so that they can be adapted quickly to the applicable wound roll position.

While the exemplary embodiments have been described as utilizing a rocker with a curved path of motion, it is also contemplated that the path of motion for the rockers may extend linearly.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particular disclosed herein; rather, the present invention extends to all functionally equivalent structures, methods and uses, such as are within the scope of the appended claims.

What is claimed is:

1. A roll winder comprising:

a roll retainer adapted to hold a winding core of a wound roll in the region of a wound roll rotational axis;

a support apparatus including a plurality of roll bodies having axes extending substantially parallel to the rotational axis of the wound roll;

the plurality of roll bodies being formed into a plurality of roll pairs, wherein individual rolls of the roll pairs are circumferentially spaced from each other;

each of the plurality of roll pairs being pivotably mounted for movement around a respective shaft extending substantially parallel to the rotational axis of the wound roll;

a pivotable rocker having a pivot shaft extending substantially parallel to the rotational axis of the wound roll;

the plurality of roll pairs comprising two circumferentially spaced pairs of rolls coupled to the pivotable rocker;

a carrier being coupled to the pivotable rocker and being pivotably mounted to move about a pivot axis extending substantially parallel to the rotational axis of the wound roll; and the carrier comprising a carrier pivot drive mechanism.

2. The roll winder of claim 1, the two pairs of rolls being spaced apart from one another on the pivotable rocker, and outermost rolls of the two pairs of rolls being spaced apart a distance of less than approximately 800 mm; and the two pairs of rolls being positionable under a wound roll relative to the direction of gravity.

3. The roll winder of claim 1, the pivot axis of the carrier being stationary.

4. The roll winder of claim 1, the spacing of the plurality of roll bodies and a spacing of bearing points of the wound roll from the pivot shafts of the two pairs of rolls are adapted to correspond to a spacing of the roll pair shafts, the pivotable rocker shaft, and the carrier shaft;

wherein, as the diameter of the wound roll increases, the wound roll is supported substantially symmetrically to a vertical center plane.

5. The roll winder of claim 1, the rocker is pivotable relative to the carrier by an angle on the order of magnitude of between approximately 50° to 100°.

6. The roll winder of claim 1, a rocker pivot drive mechanism is arranged between the carrier and the rocker.

7. The roll winder of claim 1, wherein the roll bodies have an elastic surface.

8. The roll winder of claim 1, wherein, at an onset of winding a wound roll on a winding tube, one of the roll pairs of the support apparatus is movably positioned along a fixed path against one of the winding tube and the wound roll; and wherein as a diameter of the wound roll increases, all of the rolls of the support apparatus are positioned beneath the wound roll to support the wound roll.

9. The roll winder of claim 1, wherein the rocker is displaceable to facilitate expelling of a finished wound roll.

10. The roll winder of claim 1, the support apparatus being composed of segments that are arranged adjacent to each other; and wherein a total number of segments is dependent on a width of the web to be wound.

11. A roll winder comprising:

a roll retainer adapted to hold a winding core of a wound roll in the region of a wound roll rotational axis;

a support apparatus including a plurality of roll bodies having axes extending substantially parallel to the rotational axis of the wound roll;

the plurality of roll bodies being formed into a plurality of roll pairs;

each of the plurality of roll pairs being pivotably mounted for movement around a respective shaft extending substantially parallel to the rotational axis of the wound roll;

a pivotable rocker having a pivot shaft extending substantially parallel to the rotational axis of the wound roll;

the plurality of roll pairs comprising two pairs of rolls coupled to the pivotable rocker;

the two pairs of rolls being spaced apart from one another on the pivotable rocker, and outermost rolls of the two pairs of rolls being spaced apart a distance of less than approximately 800 mm;

the two pairs of rolls being positionable under a wound roll relative to the direction of gravity;

a carrier pivotably mounted to move about a pivot axis extending substantially parallel to the rotational axis of the wound roll;

the carrier and the rocker being rigidly coupled together; and the carrier being pivotable about an angle on the order of magnitude between approximately 60° to 100°.

12. A support device for a roll winder that includes a central roll, a roll retainer adapted to be coupled to a winding tube upon which a wound roll is formed, the support device comprising:

a rocker device;

a first and second roll pair which are circumferentially spaced and pivotably coupled to the rocker device, wherein individual rolls of the first and second roll pairs are circumferentially spaced;

a carrier pivotably coupled to the rocker device; and an end of the carrier remote from the rocker device being pivotably coupled below a rotational axis of the central roll.

13. The support device of claim 12, further comprising:

a rocket device drive mechanism coupled between the carrier and the rocker device;

a carrier drive mechanism coupled between the carrier and a stationary part;

wherein during a beginning part of a winding procedure, the rocker device drive mechanism and the carrier drive mechanism drive the first roll pair to press the winding tube against the central roll, and to press the wound roll against the central roll; and wherein during a latter part of the winding procedure, the first and second roll pairs are adapted to support an outer circumferential surface of the wound roll.

14. A process of forming a wound roll with a roll winder and a support apparatus, the roll winder including a roll retainer adapted to hold a wound roll in the region of a wound roll rotational axis, and the support apparatus including a plurality of roll bodies having axes extendign substantially parallel to the rotational axis of the wound roll, such that the plurality of roll bodies form a plurality of roll pairs, in which individual rolls of the roll pairs are circumferentially spaced from each other, and the roll pairs are circumferentially spaced from each other and pivotably mounted for movement around a shaft extending substantially parallel to the rotational axis of the wound roll, the process comprising:

positioning one of the roll pairs against a winding tube;

pressing the winding tube against a central roll with the one roll pair;

guiding a web onto the winding tube and rotating the winding tube to form a wound roll; and pivoting the one roll pair so that all of the plurality of roll pairs are positioned beneath the wound roll.

15. The process of claim 14, further comprising:

pivoting the plurality of roll pairs when winding of the wound roll is complete, whereby the wound roll is expelled from the roll winder.

16. The process of claim 14, wherein the roll pairs are pivotably mounted on a rocker, the rocker includes a rocker shaft, and the process further comprises:

moving the rocker shaft along an arcuate path.

17. The process of claim 14, wherein the roll pairs are pivotably mounted on a rocker, the rocker includes a rocker shaft, and the process further comprises:

moving the rocker shaft along a linear path.

18. A process of forming a wound roll with a roll winder and a support apparatus, the roll winder including a roll retainer adapted to hold a wound roll in the region of a wound roll rotational axis, and the support apparatus including a plurality of roll bodies having axes extendign substantially parallel to the rotational axis of the wound roll, such that the plurality of roll bodies form a plurality of roll pairs, and the roll pairs are pivotably mounted for movement around a shaft extending substantially parallel to the rotational axis of the wound roll, the process comprising:

positioning one of the roll pairs against a winding tube;

pressing the winding tube against a central roll with the one roll pair;

guiding a web onto the winding tube and rotating the winding tube to form a wound roll;

pivoting the one roll pair so that all of the plurality of roll pairs are positioned beneath the wound roll; and pivoting the one roll pair when a diameter of the wound roll is approximately 500 mm.

19. A process of forming a wound roll with a roll winder and a support apparatus, the roll winder including a roll retainer adapted to hold a wound roll in the region of a wound roll rotational axis, and the support apparatus including a plurality of roll bodies having axes extending substantially parallel to the rotational axis of the wound roll, such that the plurality of roll bodies form a plurality of roll pairs, and the roll pairs are pivotably mounted for movement around a shaft extending substantially parallel to the rotational axis of the wound roll, the process comprising:

positioning one of the roll pairs against a winding tube;

pressing the winding tube against a central roll with the one roll pair;

guiding a web onto the winding tube and rotating the winding tube to form a wound roll;

pivoting the one roll pair so that all of the plurality of roll pairs are positioned beneath the wound roll; and positioning all of the plurality of roll pairs beneath the wound roll when a diameter of the wound roll is approximately 800 mm.

* * * * *